US005658002A

United States Patent [19]

Szot

[11] Patent Number: 5,658,002

[45] Date of Patent: Aug. 19, 1997

[54] WHEELCHAIR ART ATTACHMENT

[76] Inventor: Dwayne R. Szot, 1093 23rd Ave. SE., Mpls., Minn. 55414

[21] Appl. No.: 504,436

[22] Filed: Jul. 20, 1995

[51] Int. Cl.[6] ..... A46B 11/00

[52] U.S. Cl. ..... 280/304.1; 401/48; 401/195

[58] Field of Search ..... 280/250.1, 304.1, 280/288.4; 401/48, 118, 131, 208, 195; D4/122, 123; 15/159.1; 101/335

[56] References Cited

U.S. PATENT DOCUMENTS

| | | | |
|---|---|---|---|
| 1,584,687 | 5/1926 | Ault | 401/48 |
| 1,835,641 | 12/1931 | Finfrock | 401/48 |
| 2,247,622 | 7/1941 | Thompson | 401/48 |
| 2,556,121 | 6/1951 | Thomas | 280/304.1 |
| 3,083,967 | 4/1963 | Steel | 280/304.1 |
| 3,405,954 | 10/1968 | Wolfe | 280/304.1 |
| 4,305,601 | 12/1981 | Berge | 280/304.1 |
| 4,753,449 | 6/1988 | Doucet | 280/304.1 |
| 4,765,766 | 8/1988 | Heitmann et al. | 401/131 |

*Primary Examiner*—Anne Marie Boehler
*Attorney, Agent, or Firm*—Patterson & Keough, P.A.

[57] ABSTRACT

A wheelchair attachment that is designed to be attached to a wheelchair having a seat supported by a frame and oriented such that an occupant faces in the forward direction of the wheelchair and ground engaging wheels rotatably mounted on the frame includes a pigment applicator for applying selected pigmentation to a surface. The pigment applicator is supported in a glider. An extender positions the pigment applicator forward of the wheelchair. A bracket selectively, removably couples the wheelchair attachment to the wheelchair. The bracket is coupled to the extender and is also operably coupled to the frame of the wheelchair. Motion of the wheelchair over the ground causes translation of the pigment application means relative to the surface. Such translation results in the imposition of pigment on the surface.

12 Claims, 4 Drawing Sheets

WHEELCHAIR ART ATTACHMENT

TECHNICAL FIELD

The present invention relates generally to wheelchair attachments. More particularly, the present invention relates to such attachments that are adaptable to use for artistic expression.

BACKGROUND OF THE INVENTION

There is a need to provide recreational and self expressive outlets for individuals confined to a wheelchair. In the past, concentration has centered on providing wheelchair attachments that are adapted to permit an individual to participate in various sports activities. U.S. Pat. No. 3,083,967 to Steel discloses a wheelchair attachment that permits an individual seated in the wheelchair to participate in the sport of bowling. The disclosure includes a pair of parallel sloped rails designed to control and launch a bowling ball. The rails were clamped to the arm and footrests of the wheelchair. U.S. Pat. No. 4,753,449 to Doucet discloses a further sports related wheelchair attachment. The idea disclosed in Doucet is a single moveable L shaped arm that supports a sports device at one end, such as a basketball. The attachment is provided with a clamp that is affixed to a generally horizontal wheelchair support located proximate one of the armrests.

Little attention has been paid to providing means to permit individuals that are confined to a wheelchair to express themselves in an artistic manner. The human need for creative expression is a primary need, necessary for self-fulfillment and self-esteem. For individuals with disabilities, art is one of the activities in which they can excel, given the opportunity. Accordingly, there is a need for an attachment to a wheelchair with which an individual can achieve success and build self-esteem, confidence and awareness of their creativity. Such an attachment should assist the individual that is confined to the wheelchair to increase alertness, range of motion, functional independence, and communication skills.

SUMMARY OF THE INVENTION

The present invention substantially meets the aforementioned needs by providing a means of artistic expression for an individual that is confined to a wheelchair and possesses rather limited upper body motor skills. The attachment has a plurality of expression generating modalities in order to provide a variety of different types of artistic expression. The attachment is usable by any individual possessing the requisite skills to command the motion of the wheelchair.

The present invention is a wheelchair attachment that is designed to be attached to a wheelchair having a seat supported by a frame and oriented such that an occupant faces in the forward direction of the wheelchair and ground engaging wheels rotatably mounted on the frame. The invention includes a pigment applicator for applying selected pigmentation to a surface. The pigment applicator is supported in a glider. An extender is utilized to position the pigment applicator forward of the wheelchair. A bracket is utilized to selectively, removably couple the wheelchair attachment to the wheelchair. The bracket is coupled to the extender and is also operably coupled to the frame of the wheelchair. Motion of the wheelchair over the ground causes translation of the pigment application means relative to the surface. Such translation results in the imposition of pigment on the surface.

DETAILED DESCRIPTION OF THE DRAWINGS

Figure 1:
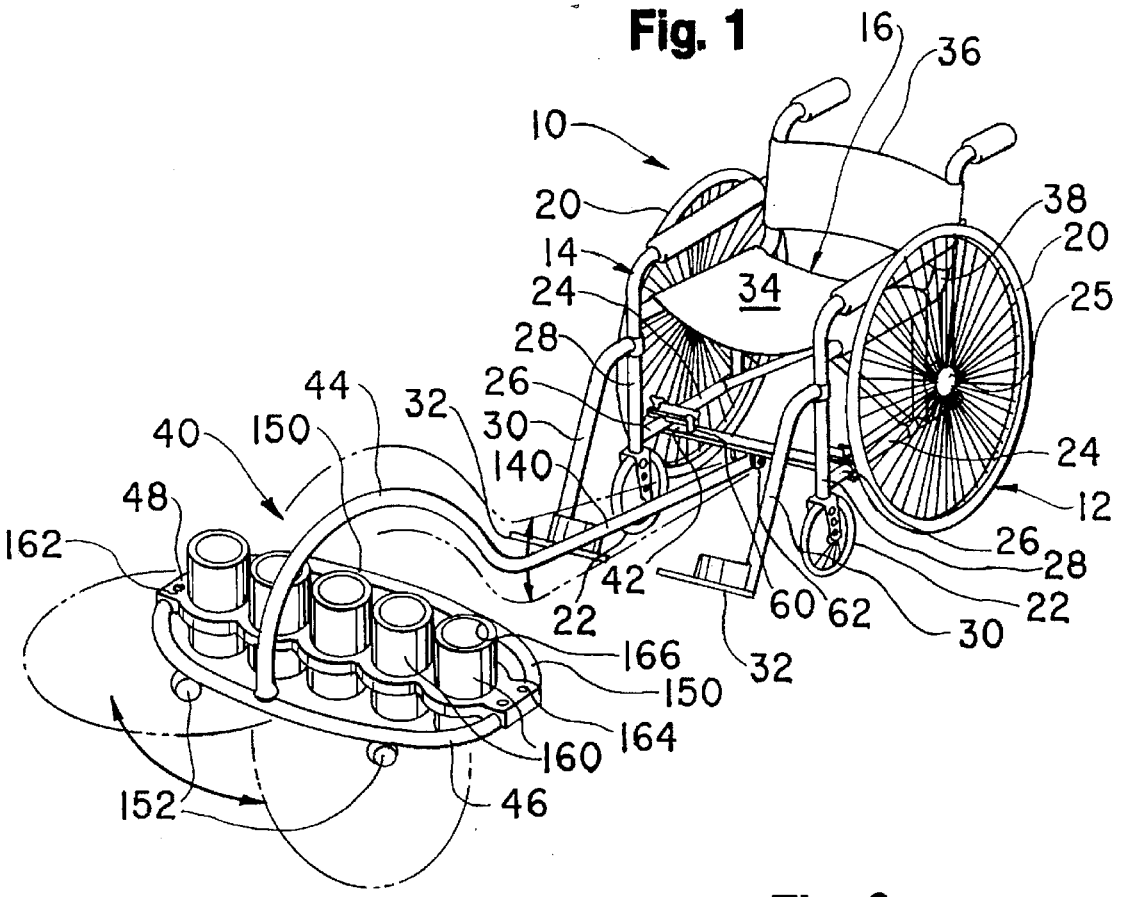
FIG. 1 is a perspective view of a first preferred embodiment of the present invention attached to the wheelchair.
Figure 2:
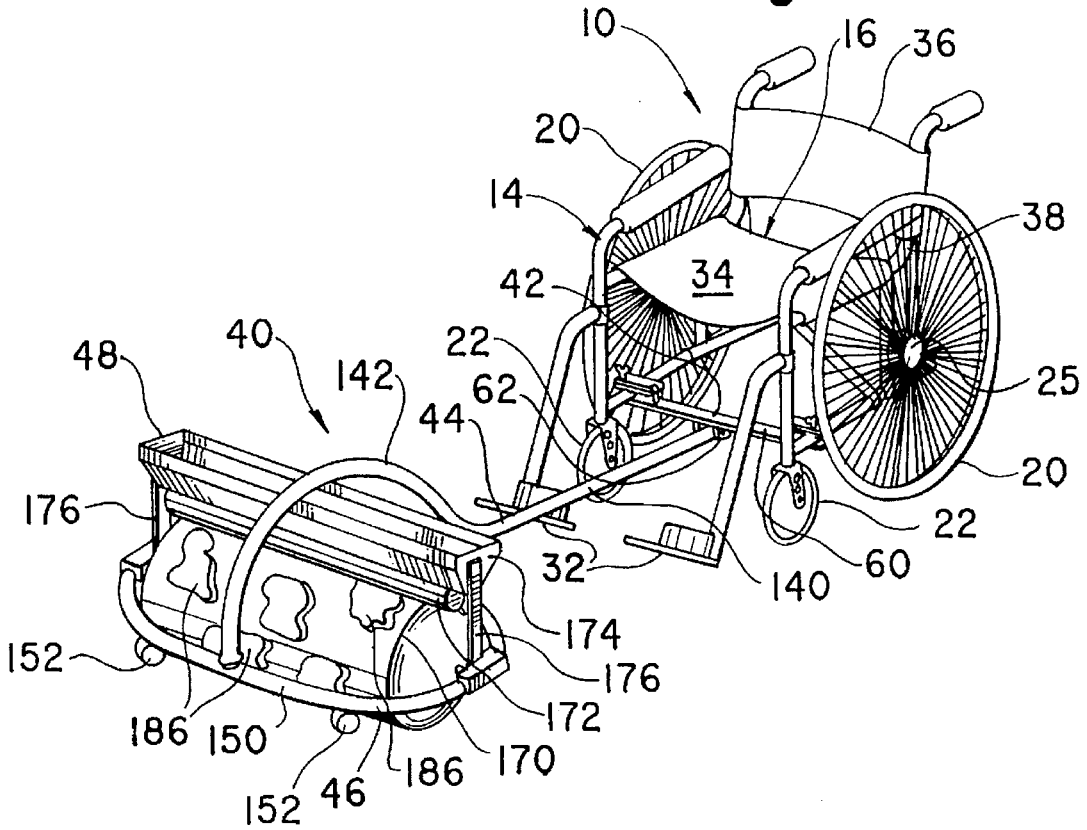
FIG. 2 is a perspective view of a second preferred embodiment of the present invention attached to the wheelchair.

A wheelchair is shown generally at 10 in FIGS. 1 and 2. The wheelchair 10 has three major subcomponents; the wheels 12, the chassis 14 and the seat 16.

A typical wheelchair 10 includes four wheels 12. There are two major support wheels, one located on either side of the chassis 14 that typically include means to manually grasp and rotate the wheels 20. Additionally, there are two forward mounted, castoring front support wheels 22.

A wheelchair 1 typically has a chassis 14 that is formed of two substantially identical sidemembers that are formed from tubes or bars. The two sidemembers are held spaced apart by crossmembers. When so positioned the bars of one sidemember are substantially parallel with the corresponding bars of the second sidemember. The crossmembers may be collapsible in order to fold and store or transport the wheelchair. The chassis 14 depicted in FIGS. 1 and 2 has two parallel lower horizontal bars 24. A main wheel hub holder 25 is fixedly attached to each of the lower horizontal bars 24. The hub holder 25 supports the axle of the main support wheels 20. Other configurations of the chassis 14 are known.

The front castoring wheels 22 are supported by front wheel supports 26. The front wheel supports 26 are pivotally coupled to the front vertical bars 28. The front vertical bars 28 are formed generally transverse to the lower horizontal bars 24. Leg supports 30 are selectively rotatably joined to the front vertical bars 28. The leg supports 30 may be rotated to the side to assist in seating an occupant in the wheelchair 10. A footrest 32 is attached to each of the leg supports 30.

A seat support 38 is fixedly attached to the upper end of the front vertical bars 28. The seat support 38 extends rearward to provide a pair of hand grips for pushing the wheelchair 10.

The seat 16 is comprised of a seat support 34 and a back support 36. Both the seat support 34 and back support 36 are preferably made of flexible material and are supported between two seat supports 38.

The art attachment of the present invention is shown generally at 40 in FIGS. 1 and 2. The art attachment 40 is comprised of four major components; the attaching bracket 42, the extender bar 44, the glider 46, and the application apparatus 48.

The attaching bracket 42 is comprised of a crossmember 60. The crossmember 60 is preferably formed from a U shaped metal channel piece, but plastic or other suitable materials could also be used. Preferably, the opened side of the U shaped channel piece that forms crossmember 60 is directed toward the components of the chassis 14 to which the attaching bracket 42 is affixed when the attaching bracket 42 is affixed the chassis 14 of the wheelchair 10.

Figure 8:
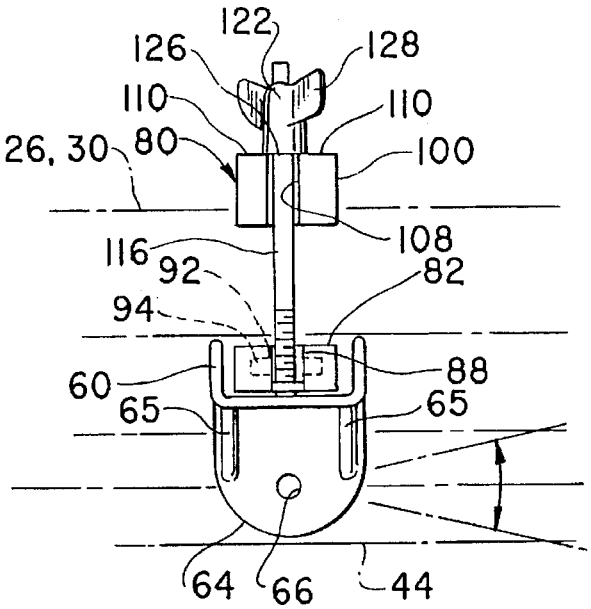
FIG. 8 is a side plan view of the clamp affixing the extender bar to the frame of the wheelchair.
Figure 9:
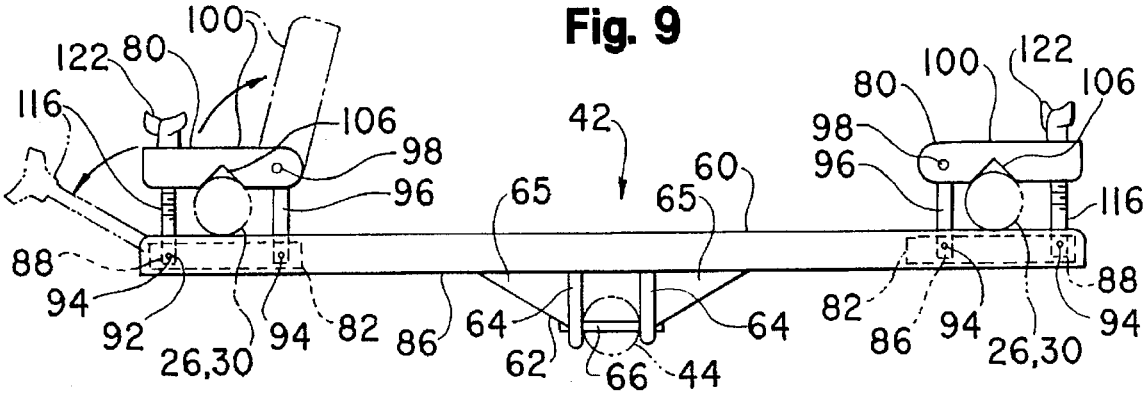
FIG. 9 is a front plan view of the clamp affixing the attaching bracket to the frame of the wheelchair.
Figure 10:
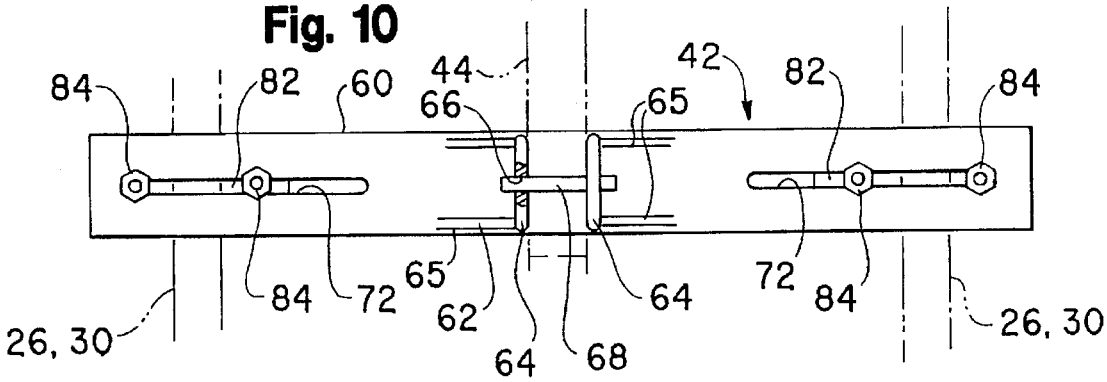
FIG. 10 is a bottom plan view of the attaching bracket.

The crossmember 60 has a clevis fitting 62 that is downwardly directed as depicted in FIGS. 1 and 2 and disposed approximately mid-span of the crossmember 60. The clevis fitting 62 is best viewed by referring to FIGS. 8–10. The clevis fitting 62 has two parallel clevis ears 64 that are laterally supported by a pair of gussets 65 extending between the clevis ears 64 and the underside of the crossmember 60. Two bores 66 are formed in registry in the clevis ears 64. A clevis pin 68 is disposed within the two bores 66, extending therebetween. A pair of spaced apart, race track slots 72 are formed in the crossmember 60 proximate either end thereof.

Referring again to FIGS. 8–10, a clamp 80 is disposed proximate either end of crossmember 60 for removably affixing the art attachment 40 to the wheelchair 10 disposed within the channel of the crossmember 60. The clamp 80 has an elongated base 82, having two bores (not shown) defined therein. The bores are aligned with the race track slots 72 of the crossmember 60. Adjusting bolts 84 are passed through the bores and through the race track slots 72. The clamp 80 is positionable laterally, the amount of lateral travel permitted by the race track slots 72. The lateral travel is in order to accommodate wheelchairs 10 of varying width. The clamp 80 has a first clevis 86 and a second clevis 88. Each such clevis 86, 88 has a clevis pin 94.

The first clevis 86 has a clamp extender 96 that is carried at its first end by the clevis pin 94. The clamp extender 96 is pivotally coupled to the clamp arm 100 at the second end of the clamp extender 96 by clamp extender pin 98. A notch 106 is defined in the underside of the clamp on 100. The notch 106 is adapted to compressively engage a bar of the chassis 14 as for example, front wheel supports 26 and leg supports 30.

A groove 108 is defined in the clamp arm 100 by the groove arms 110. The clamp arm 100 is compressively engaged with the base 82 by a pivotable threaded bar 116.

The threaded bar 116 is pivotally affixed to the base 82 by a pin 94.

A sleeve 122 has a threaded bore (not shown) defined therein. The threaded bore is threadingly engaged with the threads of the threaded bar 116. Sleeve 122 includes a base 126 that compressively engages the upper surface of the arms 110. A butterfly handle 128 is utilized to rotate the sleeve 120 on the threaded bar 116 to bring the base 126 into engagement with the arms 110.

Referring again to FIGS. 1 and 2, the extender bar 44 of the art attachment is preferably comprised of a metallic tube that preferably has a straight portion 140 and an arched portion 142. The extender bar 44 may also be formed of a plastic material, such as PVC. The arched portion 142 is designed to rise above the application apparatus 48 to be pivotally coupled to the glider 46 at the leading edge of the glider 46, so that forward motion of the wheelchair 10 exerts a pulling force on the glider 46.

The glider 46 has a glider frame 150. The glider frame 150 is closed, thereby defining an opening within the glider frame 150. The application apparatus 48 is designed to be borne within the opening defined within the glider frame 150.

Figure 3:
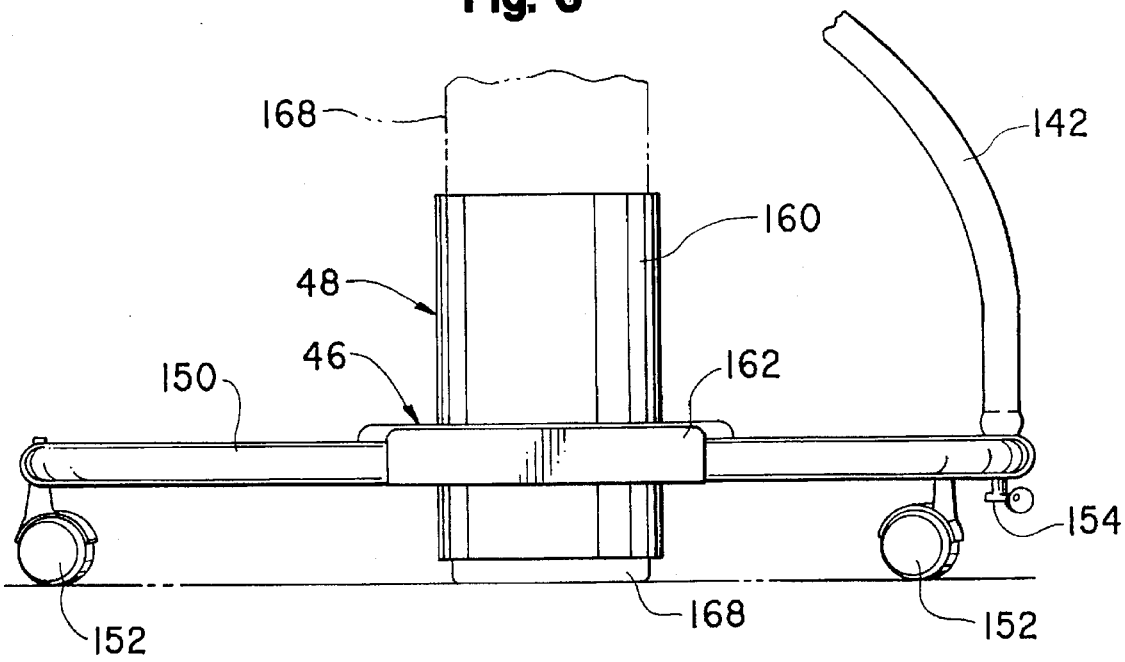
FIG. 3 is a side plan view of the glider portion of the first preferred embodiment of the present invention.
Figure 4:
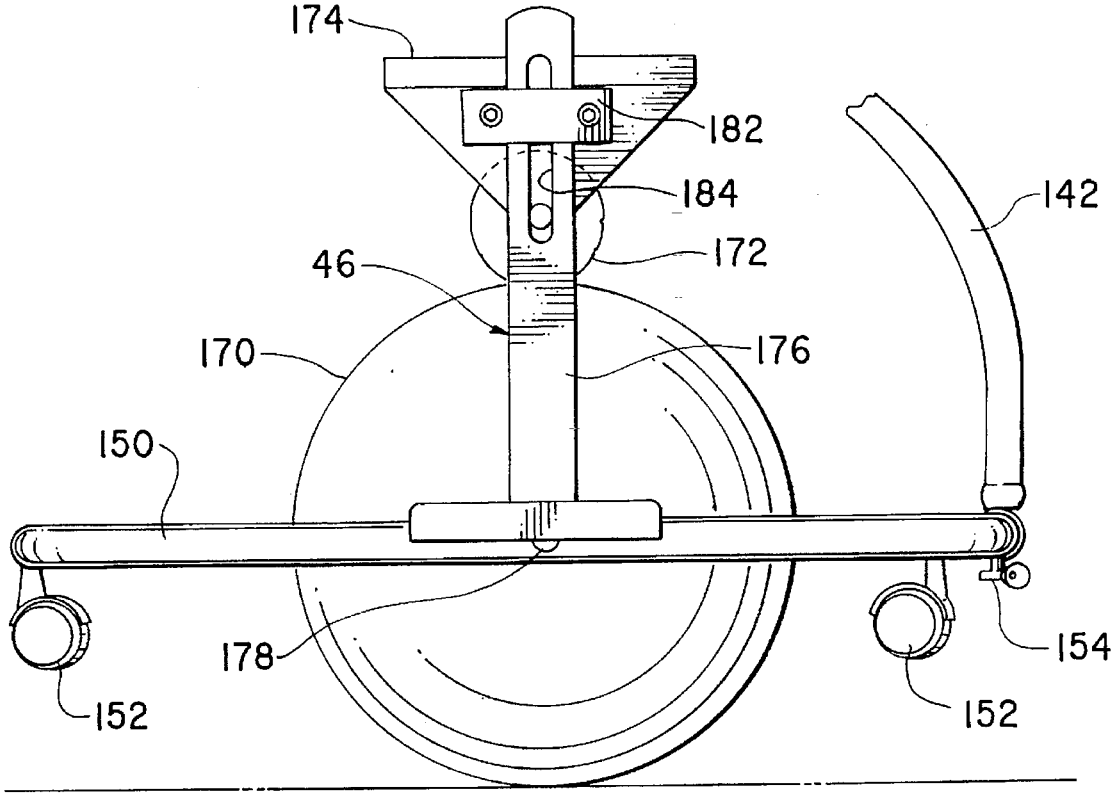
FIG. 4 is a side plan view of the glider of the second preferred embodiment of the present invention.

The glider frame 150 preferably has three castors 152. With certain types of application apparatus 48, the castors 152 will be in contact with the ground, as depicted in FIG. 3. With other types of application apparatus 48, as depicted in FIG. 4, the castors 152 merely depend from the glider frame 150 and play no active roll in supporting the art attachment 40. In the embodiment of FIG. 4, the castors are useful in preventing the art attachment 40 from tipping over when the art attachment 40 encounters some resistance in the translation over the surface.

Figure 7:
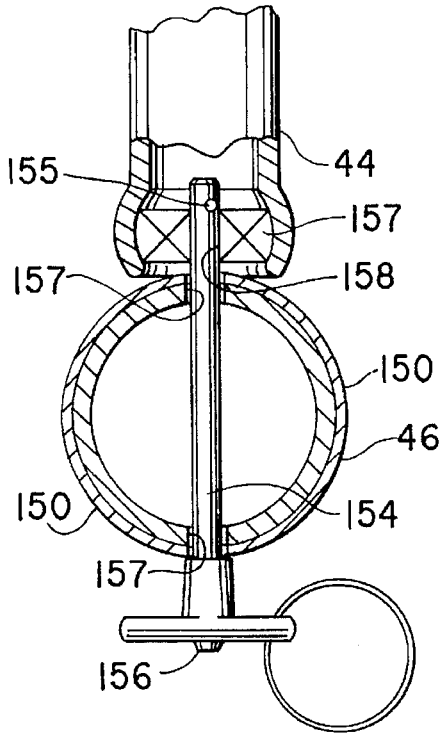
FIG. 7 is a side sectional view of the attaching point between the extended bar and the glider portions.

As depicted in FIGS. 3, 4, and more particularly, in FIG. 7, the extender bar 44 rotatably connected to the glider frame 150 by a spring loaded locking pin 154.

The spring loaded locking pin 154 has a retractable ball lock 155 that is coupled to a lock actuator 156. In the locked position, the ball lock 155 protrudes beyond the circumference of the locking pin 154. Upon depression of the lock actuator 156, the ball lock 155 is retracted within the locking pin 154. The locking pin 154 is shown inserted through bores 157 formed in the top and bottom of the glider frame 150. The locking pin 154 then passes through the bore 158 formed in the retainer block 159. The retainer block 159 is compressively held within the end of the arched portion 142 of the extender bar 144. The circumference of the bore 158 is designed such that the locking pin 154 passes freely through the bore 158 and when the retracting ball lock 155 is in the locked position, the retracting ball lock 155 retains the locking pin 154 within bore 158.

Figure 5:
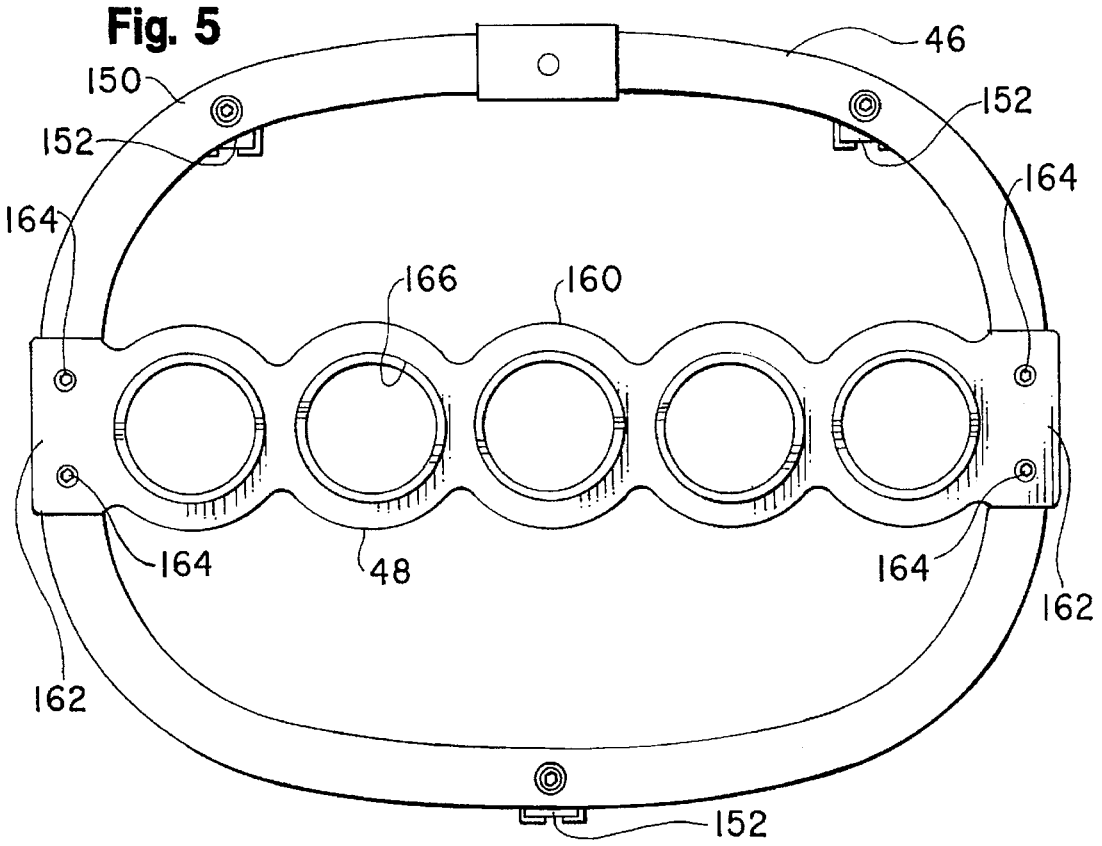
FIG. 5 is a top plan view of the glider portion of the first embodiment.

A first preferred embodiment of the application apparatus 48 is depicted in FIGS. 3 and 5. The application apparatus 48 is a device for imposing chalk marks on the surface over which the application apparatus 48 translates.

The application apparatus 48 includes a plurality of adjacent chalk holder 160. A chalk holder 160 may be formed from short sections of standard PVC drain tubing having an outside diameter of approximately four inches. The chalk holders 160 are supported within a bracket 162 that extends over the glider frame 150 and is affixed thereto by bolts 164. A relatively large chalk stick 168 is inserted loosely within each of the chalk holders 160. The weight of the chalk stick causes it to bear on the surface beneath the application apparatus 48. In practice, each of the chalk sticks 168 may be of a different color.

Figure 6:
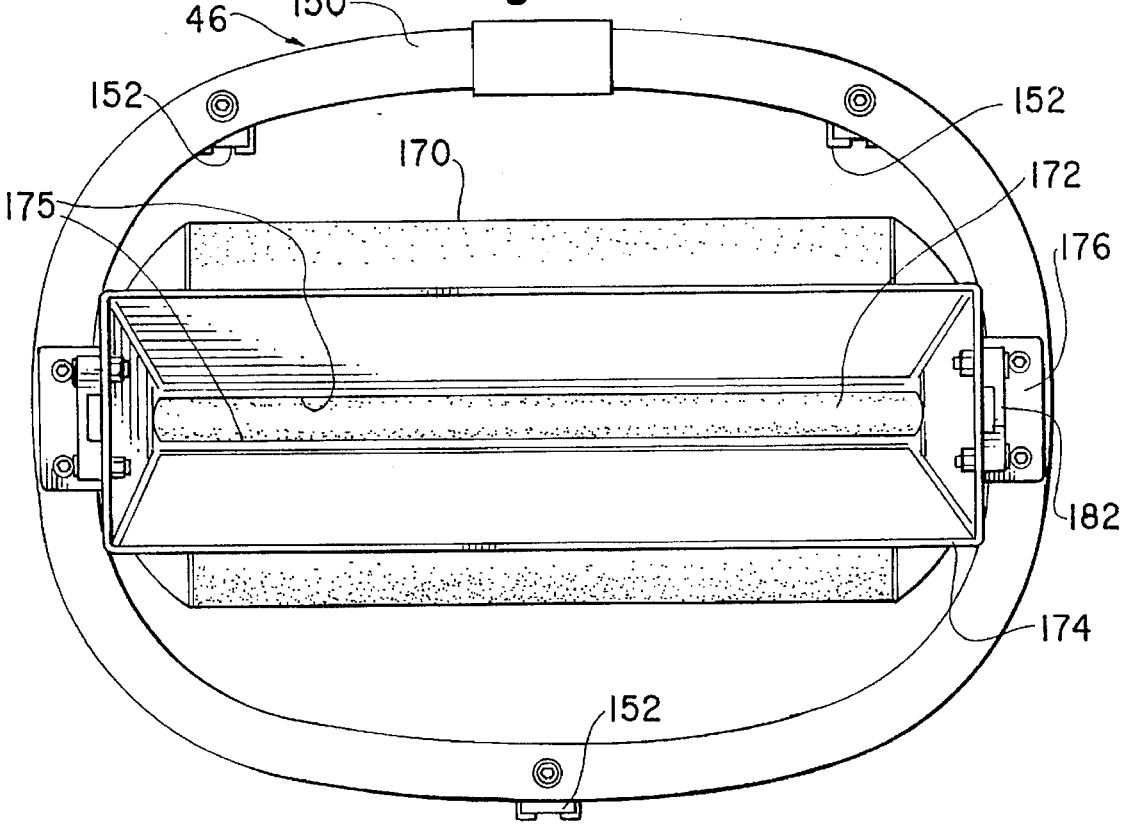
FIG. 6 is a top plan view of the glider portion of the second preferred embodiment.

A second preferred embodiment of the application apparatus 48 is depicted in FIGS. 4 and 6. The application apparatus 48 shown here is adapted to applying paint to the surface over which the application apparatus 48 translates.

The application apparatus 48 preferably includes two rollers. Roller 170 is a relatively large roller having a diameter that is preferably approximately 12 inches. A smaller counter roller 72 is positioned on top of the roller 170, in compressive rotatable engagement therewith, such that rotation of roller 170 causes counter directional rotation of counter roller 72.

A paint reservoir 174 is positioned on top of the counter roller 172. A paint outlet 175 formed in the bottom of paint reservoir 174 is in flow communication with the counter roller 172.

Brackets 176 are affixed to the glider frame 150 by bolts 177. An axial counter roller support 180 is provided about which the counter roller 172 rotates and a race track slot 174 is formed within the brackets 176 in order to properly position the paint reservoir 174 with respect to the counter roller 172. An axial roller support 178 about which the roller 170 rotates is anchored in the glider frame 150.

As depicted in FIG. 2, compressive, paint absorbent pads 186 may be adhered to the external surface of the roller 170.

The pads 186 may be of any selected shape in order to provide a desired pattern of the paint being applied to the surface over which the application apparatus 48 translates.

In operation, the attaching bracket 42 is first attached to parallel bars of the two side members of the chassis 14 of the wheelchair 10. With the wheelchair 10 as depicted in FIGS. 1 and 2, the attaching bracket 42 could be attached to either the two front wheel supports 26, the two front vertical bars 28, or the two leg supports 30. The extender bar 44 projects forward from the attaching bracket 42 between the two footrests 32 of the wheelchair 10. As depicted in FIG. 1, the extender bar 44 is free to move in a vertical plane, as indicated by the arrows, responsive to undulations in the surface over which the wheelchair 10 and art attachment 40 are translating at any given time. By pivotally attaching the extender bar 44 to the front portion of the glider 46, the glider 46 is effectively pulled along by the extender bar 44. The glider will move to the right or the left, as indicated by the arrow, responsive to turning motion of the wheelchair 10.

To impose pigmentation of the surface over which the art attachment 40 is translating, the chalk sticks 168 are placed within the chalk holders 160. The weight of the chalk sticks 168 bears upon the surface over which the art attachment 40 is translating and frictional forces between the chalk stick 168 and such surface results in imposition of a pigment upon the surface. The pigmentation may be applied directly to the surface, such as the surface of a parking lot.

With the alternative embodiment of the application apparatus 48, the paint reservoir 174 is filled with liquid paint. The upper portion of the counter roller 172 is wetted by the paint. As the roller 170 translates over the surface, the counter roller 172 is caused to rotate in the opposite direction. The paint on the surface of the counter roller 172 is pressed onto the surface of the roller 170 and then to the surface over which the application apparatus 48 is translating. With the embodiment of the roller 170 as depicted in FIG. 2, the paint from the counter roller 172 is absorbed by the pads 186, to subsequently be imposed on the surface in a pattern that substantially replicates the pattern of the pads 186.

A surface, such as linoleum, a large paper sheet, or even T-shirts may be placed on the ground beneath the roller 170. Translation of the art attachment 40 over the surface results in creation of a mural, large painting, or a patterned T-shirt.

It will be understood that although two preferred embodiments of this invention have been disclosed, that various alterations in the design may be resorted to without parting from the spirit of the invention and while still falling within the scope of the appended claims.

I claim:

1. A wheelchair attachment designed to be attached to a wheelchair having a seat supported by a frame and oriented such that an occupant faces in the forward direction of the wheelchair and ground engaging wheels rotatably mounted on the frame, comprising:

pigment application means for applying selected pigmentation to a surface;

glider means for supporting the pigment application means and being operably coupled thereto;

extender means for positioning the pigment application means forward of the wheelchair, having first and second ends, the first end being operably, rotatably coupled to the glider means; and bracket means for selectively, removably coupling the wheelchair attachment to the wheelchair being operably, pivotally coupled to the second end of the extender means and being operably coupled to the frame of the wheelchair, whereby motion of the wheelchair over the ground causes translation of the pigment application means relative to the surface, such translation resulting in the imposition of pigment on the surface.

2. A wheelchair attachment as claimed in claim 1 wherein the glider means has a closed frame forming the perimeter of an opening defined therein, the pigment application means being disposed within the opening.

3. A wheelchair attachment as claimed in claim 1 wherein the pigment application means includes a plurality of chalk stick holders.

4. A wheelchair attachment as claimed in claim 3 wherein the chalk stick holders are tubes having an inner and an outer surface, the inner surface defining an aperture therethrough and including a chalk stick loosely disposed within the aperture whereby the weight of the chalk stick urges the chalk stick into engagement with the surface.

5. A wheelchair attachment as claimed in claim 1 wherein the pigment application means is a paint roller applicator.

6. A wheelchair attachment as claimed in claim 5 wherein the paint roller applicator has a first roller that bears upon the surface, a counter roller that is rotatably engaged with the first roller and a paint reservoir having a paint outlet that is in flow communication with the counter roller, whereby rotational translation of the first roller over the surface acts to rotate the counter roller in a direction opposite thereto, the rotating counter roller having paint from the paint reservoir and depositing such paint on the first roller for application to the surface.

7. A wheelchair attachment as claimed in claim 6 wherein the first roller of the paint roller applicator has a plurality of paint absorbent pads disposed thereon, the pads having selected shapes whereby paint is expressed from the pads as the first roller translates over the surface to impose a paint design on the surface that is substantially a replica of the shape of the pads.

8. A wheelchair attachment as claimed in claim 2 wherein the first end of the extender means is coupled to the glider means at a selected coupling point on the glider frame whereby substantially forward motion of the wheelchair causes the glider to trail behind the coupling point.

9. A wheelchair attachment as claimed in claim 8 wherein the rotatable coupling of the first end of the extender means to the glider means permits rotation of the glider means relative to the extender means in a plane substantially parallel to the plane of the surface.

10. A wheelchair attachment as claimed in claim 1 wherein the pivotal coupling of the second end of the extender means to the bracket means accommodates motion of the extender means in a substantially vertical plane responsive to undulations in the surface over which the pigment application means translates.

11. A wheelchair attachment as claimed in claim 1 including the frame of the wheelchair having two substantially identical sidemembers formed of bar members being parallel and spaced apart by crossmembers wherein the bracket means is adapted to be operably coupled to parallel corresponding bar members of the two side members.

12. A wheelchair attachment as claimed in claim 2 further including the bracket means having clamping means for selectively, fixedly clamping the bracket means to the frame of the wheelchair such that the bracket means is substantially parallel to the ground.

* * * * *

UNITED STATES PATENT AND TRADEMARK OFFICE

CERTIFICATE OF CORRECTION

PATENT NO. : 5,658,002

DATED : August 19, 1997

INVENTOR(S) : Szot

It is certified that error appears in the above-indentified patent and that said Letters Patent is hereby corrected as shown below:

Column 3, line 8, insert "in" between "affixed" and "the".

Column 4, line 12, insert ""is" between "44" and "rotatably".

Column 5, line 19, insert "the" between "to" and "turning".

Signed and Sealed this

Sixteenth Day of December, 1997

Bruce Lehman

*Attest:*

BRUCE LEHMAN

*Attesting Officer*

*Commissioner of Patents and Trademarks*